US010166586B2

(12) United States Patent
Castle

(10) Patent No.: US 10,166,586 B2
(45) Date of Patent: Jan. 1, 2019

(54) REFORM TUB IRIS TO ALSO INCLUDE COIL SHEAR

(71) Applicant: Siemens VAI Metals Technologies GmbH, Linz (AT)

(72) Inventor: Robert John Castle, Doncaster (GB)

(73) Assignee: PRIMETALS TECHNOLOGIES USA LLC, Alpharetta, GA (US)

( * ) Notice: Subject to any disclaimer, the term of this patent is extended or adjusted under 35 U.S.C. 154(b) by 309 days.

(21) Appl. No.: 14/398,338

(22) PCT Filed: May 3, 2013

(86) PCT No.: PCT/EP2013/059204
§ 371 (c)(1),
(2) Date: Oct. 31, 2014

(87) PCT Pub. No.: WO2013/164431
PCT Pub. Date: Nov. 7, 2013

(65) Prior Publication Data

US 2015/0129080 A1 May 14, 2015

(30) Foreign Application Priority Data

May 4, 2012 (GB) ..... 1207811.9

(51) Int. Cl.
*B21C 47/14* (2006.01)

(52) U.S. Cl.
CPC ..... *B21C 47/146* (2013.01); *B21C 47/14* (2013.01)

(58) Field of Classification Search
None
See application file for complete search history.

(56) References Cited

U.S. PATENT DOCUMENTS 2,886,258 A * 5/1959 Haugwitz ..... B21C 47/14 242/361.1
3,776,076 A 12/1973 Hauck
4,011,780 A 3/1977 David
(Continued)

FOREIGN PATENT DOCUMENTS

CN 1120476 A 4/1996
CN 1096318 C 12/2002
(Continued)

OTHER PUBLICATIONS

EPO machine translation to English of DE2515643.*
(Continued)

*Primary Examiner* — Pradeep C Battula
(74) *Attorney, Agent, or Firm* — Gesmer Updegrove LLP

(57) ABSTRACT

A combined iris and shear unit for a coil forming device is provided that includes an actuator and a plurality of support members coupled together in series to support formation of a coil and connected to the actuator. Each support member further comprises a retractable shear blade. The actuator adapted to cause movement of the support members between an open position with the blades of the combined iris and shear unit being retracted away from the reform tub wall, so that coil forming takes place within the reform tub without interference. A support position with the blades extends into the reform tub and providing support for the coil; or a shear position for cutting the coil before it is extracted.

8 Claims, 5 Drawing Sheets

(56) References Cited

U.S. PATENT DOCUMENTS

| | | | | | |
|---|---|---|---|---|---|
| 5,243,746 | A * | 9/1993 | Shinichi | B21F 35/00 | 140/103 |
| 5,273,231 | A * | 12/1993 | Starvaski | B21C 47/14 | 242/363 |
| 6,073,873 | A * | 6/2000 | Shore | B21C 47/146 | 242/363 |
| 6,237,868 | B1 | 5/2001 | Shore et al. | | |
| 6,726,138 | B2 * | 4/2004 | Grimmel | B21C 47/146 | 242/363 |
| 7,856,911 | B2 * | 12/2010 | Hattersley, Jr. | B21C 47/14 | 83/130 |
| 2005/0247261 | A1 * | 11/2005 | Hattersley, Jr. | B21C 47/14 | 118/68 |

FOREIGN PATENT DOCUMENTS

| | | | | |
|---|---|---|---|---|
| CN | 104271278 | B | 12/2016 | |
| DE | 2150419 | A1 | 4/1973 | |
| DE | 2453834 | A1 | 6/1975 | |
| DE | 2420866 | A1 | 11/1975 | |
| DE | 2515643 | A1 | 10/1976 | |
| DE | 19704421 | A1 * | 8/1998 | B21C 47/146 |
| GB | 1405613 | A | 9/1975 | |
| GB | 1479278 | A | 7/1977 | |
| JP | S56119621 | A | 9/1981 | |
| JP | S56175137 | U | 12/1981 | |
| JP | S6135285 | U | 3/1986 | |
| JP | H02112824 | A | 4/1990 | |
| JP | 2001121342 | A | 5/2001 | |
| RU | 384224 | | 10/1973 | |
| RU | 1338186 | C | 10/1996 | |
| WO | 9405445 | A1 | 3/1994 | |

OTHER PUBLICATIONS

EPO translation of Shibaura JPS56-119621.*

EPO Machine Translation of DE19704421A1, Jan. 2011.*

First Office Action issued by the State Intellectual Property Office of China dated Aug. 27, 2015 in connection with related Chinese Patent App. No. 201380023324.0 and English translation thereof, 19 pages.

Office Action issued by the Japanese Patent Office dated Mar. 17, 2017 in related Japanese Application No. 2015-509446.

Office Action issued by the Russian Patent Office dated Mar. 29, 2017 in related Russian Application No. 2014143996.

Office Action issued by the Chinese Patent Office dated Apr. 25, 2016 in related Application No. 201380023324.0.

Search Report issued by the United Kingdom Patent Office dated Jun. 26, 2012 in related Application No. GB1207811.9.

PCT International Search Report dated Jul. 17, 2013 corresponding to PCT International Application No. PCT/US2013/059204 filed May 3, 2013 (11 pages).

* cited by examiner

REFORM TUB IRIS TO ALSO INCLUDE COIL SHEAR

BACKGROUND

1. Field

This invention relates to a coil forming device of a reform chamber, in particular for a wire rod mill. The invention can be installed in new mills to provide capability for dividing the coil without the tall reform area required for a reform tub shear, or can be used to allow an upgrade in existing mills.

2. Description of Related Art

In certain mills, the operators are sufficiently familiar with the mill's operation to be able to determine the steel billet requirement to produce a full coil without further calculation, so avoiding the need to cut the rod after manufacturing the coil. However, these older mills may wish to upgrade, both to benefit from more efficient technology and to offer a broader range of products to their customers. For example, rather than offering only full coils, they may wish to produce half coils, or coils of a customer specified weight. In order to do this, they need to run the input continuously and cut the rod at the correct point to achieve the required coil weight. The coil forming is carried out in a reform chamber. To cut the continuous rod requires the provision of a shear after the coil forming stage, the shear and other moving parts typically have separate power and control systems to operate them, all of which add to the cost and each stage takes up space which may be at a premium. In a typical reform chamber, a set of retractable supports or fingers, also known as an iris, is used to temporarily support the coil when it begins to fall into the chamber, so that a previously-collected coil can be removed from below the chamber. The iris can also be used to interrupt the collection of the rings for the purpose of separating the coil, as described in U.S. Pat. No. 3,776,076.

Retrofitting a reform tub with one or more support irises and a shear can be a problem because the older mills do not have sufficient vertical height where the existing reform chamber is to fit the reform tub with irises and shear. To overcome this, the only option is to dig out the floor beneath, as the mill equipment above cannot be moved. On new mills, it is advantageous to minimize the height of the reform station at the end of the conveyor to reduce the cost of foundations and other structures.

SUMMARY

In accordance with a first aspect of the present invention, a combined unit comprises an actuator and a plurality of support members coupled together in series connected to the actuator; wherein each support member further comprises a retractable shear blade.

The support members are pivotable for movement into and out of a path of descent of a ring of a coil.

In accordance with a second aspect of the present invention, a coil forming device comprises a housing, two or more supports retractably mounted on the housing; and a coil plate at the base of the housing; wherein each support is independently operable; and wherein one support further comprises shear blades.

Preferably, the device further comprises a coil height sensor at the top of the housing and a controller, whereby retraction or extension of the supports is controlled in response to signals from the height sensor received by the controller.

Preferably, the housing comprises a reform tub.

Preferably, one of the supports comprises an iris.

The fingers of the iris can be pivoted into and out of the housing to provide support during coil forming, or allow a formed coil to drop to the next support level.

Preferably, one of the supports comprises a combined unit according to the first aspect.

In accordance with a third aspect of the present invention, a method of operating a coil forming device comprises receiving a continuous rolled product at an entry to a housing; guiding the product into the housing; forming a partial coil supported by a first support in the housing, retracting the first support and dropping the partial coil onto a second support comprising a unit according to the first aspect; adding further coils to the partial coil; extending the first support; retracting the second support; and dropping the formed coil onto the coil plate.

Preferably, the method further comprises lowering the coil plate to separate the formed coil from coils above the first support, extending the second support and causing the shear blades of the second support to cut between the top of the formed coil and the bottom of the coil remaining above the first support.

Preferably, an actuator moves the second support between open, closed and shearing positions in response to signals from a controller.

The present invention enables retrofitting of an iris and shear arrangement in the reform chamber without needing to dig out the floor or installation as part of a new mill, so that the height needed for shearing can be minimised. In mills where there is sufficient space, the invention allows for an additional support stage to be included in the process, further improving the quality of the coil packing to give a smaller package for the same coil weight.

BRIEF DESCRIPTION OF THE DRAWINGS

An example of a device according to the present invention will now be described with reference to the accompanying drawings in which.

DETAILED DESCRIPTION

Figure 1:
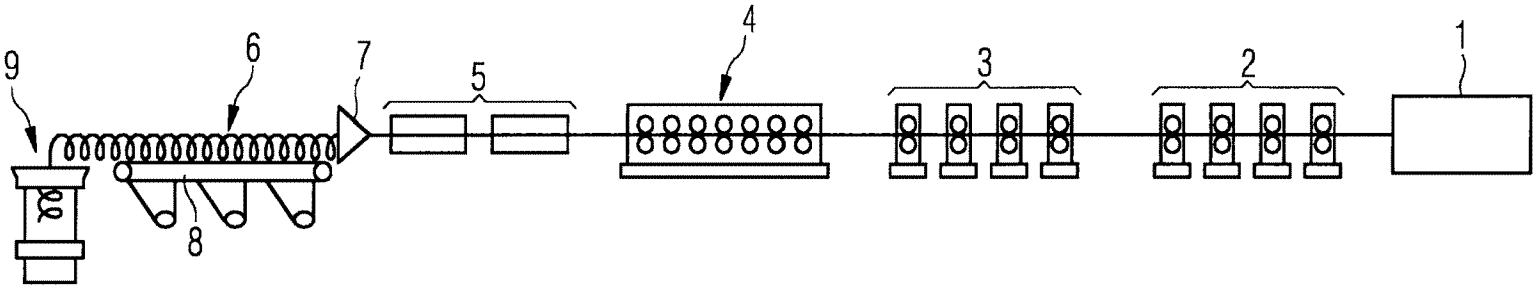
FIG. 1 illustrates steps in a thermo-mechanical process to produce steel rod.

In the present invention, an improvement is provided to the coil handling part of forming long round products by a thermo-mechanical process including both plain rod, typically with a minimum diameter of 5.5 mm and reinforcement bars (rebar), typically with a minimum diameter of 6.0 mm, which may, for example, be used in concrete reinforcement products. Typically, the rod diameter is in the range of 5.5 mm to 25 mm, but the improvement is not limited to forming rod within this size range. Although the process could be an additional step after the process of steel making, it is generally carried out separately from the steel making process in wire rod mills. As shown in FIG. 1, an example of a typical process for forming steel rod in a wire rod mill involves reheating cast steel billets in a furnace 1 and carrying out a continuous hot rolling process in roughing section 2, intermediate section 3 and finishing section 4 to form continuous wire rod. The wire rod is partially cooled in cooling section 5 and formed into loops 6 by a laying head 7 and laid on a cooling conveyor 8, such as a Stelmor-type conveyor, which carries the loops to a reform chamber 9. At the reform chamber 9, the loops are dropped vertically onto a central guide in a reform tub and formed into an annular coil in the reform tub with the assistance of a rotating guide surface, for example of the type as described in EP0583099.

Figure 2A:
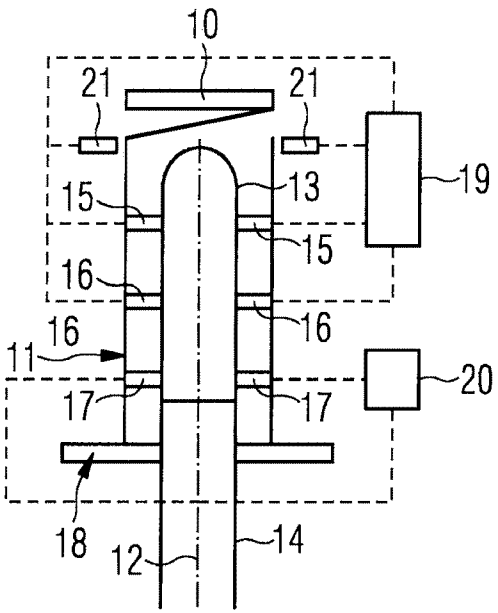
FIG. 2 illustrates parts of the reform chamber in more detail.
Figure 2B:
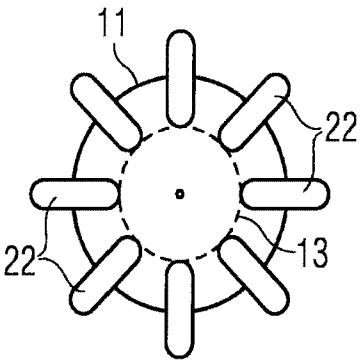
Figure 2C:
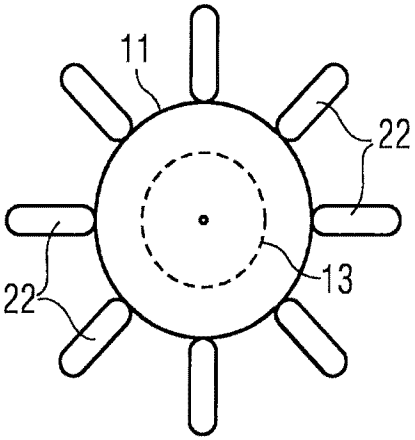
Figure 3A:
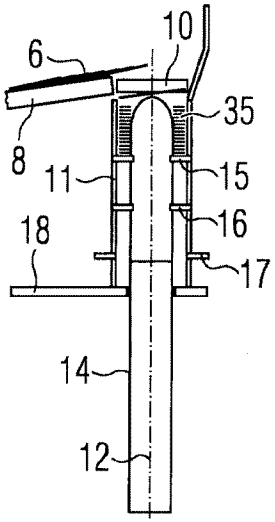
FIG. 3 illustrates an example of operation of a device for coil forming; and, FIG. 4 illustrates an example of operation of a coil forming device according to the present invention; and, FIG. 5 illustrates the combined unit of FIG. 4 in more detail.
Figure 3B:
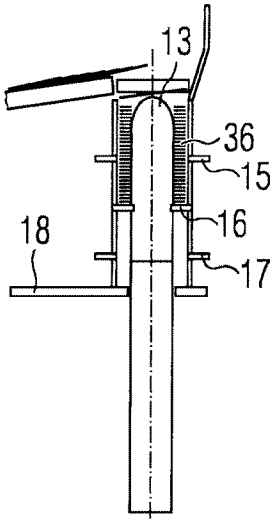
Figure 3C:
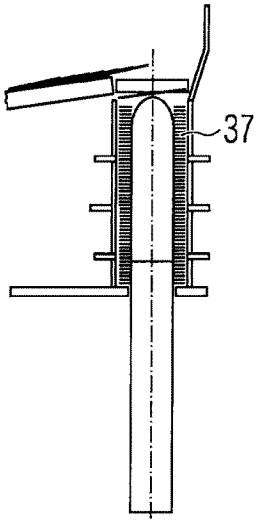
Figure 3D:
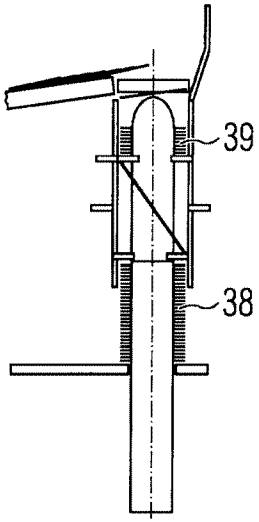
Figure 3E:
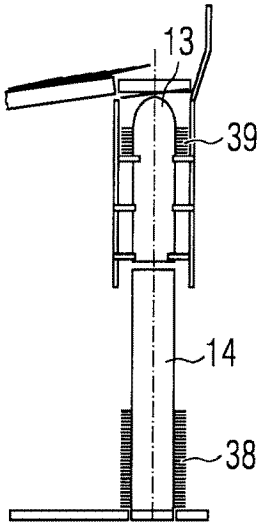

In systems as referred to above, such as described in U.S. Pat. No. 3,776,076, pivoting separator elements, also known as an iris, can be used to interrupt the collection of the rings for the purpose of separating the coil, but each divider and shear stage take up vertical height which may be at a premium in the mill. The reform chamber in which such a divider can be used is illustrated in more detail in FIGS. 2*a* to 2*c*. As shown in FIG. 2*a*, a ring distributor 10 is provided at the entry to the reform tub. The tub is generally cylindrical about an axis 12 and a nose cone 13 is provided above a stem 14, co-axial with the reform tub 11. A first iris 15 and a second iris 16 are mounted to the reform tub as well as a shear 17. At the bottom of the reform tub 11 is a coil plate 18. A first control and drive system 19 is provided for the iris 15 and a second control and drive system 20 is provided for the shear. Sensors 21 at the top of the reform tub are connected to the first control system 19. FIG. 2*b* shows the iris in its operating position, whereby the tabs 22, or fingers, of the iris protrude through the wall of the reform tub, the tips of the fingers close to, or in contact with the nose cone 13 to provide support to a coil being formed. In FIG. 2*c*, the iris is in its open position with the tabs retracted through the walls, so that the coil can fall down to the next support level.

The present invention improves upon the process of coil forming FIG. 3 illustrates an example of operation of the reform device of FIG. 2. As shown in FIG. 3*a*, loops 6 are brought by the conveyor 8 to the entry to the reform chamber 9. At the entry to the reform chamber 9 the rotating guide surface, or ring distributor 10, assists in producing a uniform distribution of coils in a controlled manner. The loops drop vertically passing through the ring distributor 10 onto the first iris 15 in the reform tub 11. A coil 35 forms inside the cylindrical reform tub 11, supported on the fingers 22 of the first iris 15 which are set at a position part-way down the reform tub. Typically, the tabs 22 are retractably mounted to project through the wall of the reform tub, their tips close to, in contact with, or passing through slots into the nose cone 13 in the centre of and co-axial with the reform tub 11 when providing support, then retracted through the tub wall and out of the reform tub when the iris 15 is in its open position. The nose cone assists in guiding the coils as they are formed. Sensors 21 determine when the coil 35 has reached a predetermined upper limit of coil height and send a signal to the controller 19 to cause the tabs 22 of the first iris to be retracted, allowing the formed coil to drop by a fixed distance to the second iris 16, as illustrated in FIG. 3*b*. This second iris will be in the position as illustrated in FIG. 2*c*, with tabs 22 extended into the reform tub The coiling process continues increasing the size of coil 36 until the top of the coil is determined to have reached the upper limit of coil height and a signal from the sensor 21 to the controller 19 causes the tabs 23 of the second iris 16 to retract and drop this coil 36 a predetermined distance onto the coil plate 18. Between the coil plate and the second iris, the shear 17 is mounted in an open position and does not interfere with the coil 36 dropping to the coil plate 18. Formation of the coil 37 continues as shown in FIG. 3*c* until the coils are again above the position of the first iris 15. The controller 19 then causes actuators to move the tabs 22 of the first iris 15 back into place, as illustrated in FIG. 3*d* and the coil plate 19 is dropped by a required amount in order for the coil 38 to be separated from coil 39 now held above the first shear 15. The separation distance opens out a helix, so that there is rod between the two coils 38, 39 set at a suitable angle for cutting and the shear 17 then operates to cut the rod. Where the tabs pass through into the nose cone, this allows the nose cone and ring distributor to be lifted by the first iris, so that the controller can move the stem down and away from the nose cone. Alternatively, the stem may be lowered, whilst the iris provides support The completed coil 38 on the coil plate 18 is moved down and extracted as shown in FIG. 3*e*. The coil plate is then returned to its initial position.

As explained above, although this mechanism is able to produce a coil with better compaction, which is shorter, so easier to handle for the same weight and as a result less prone to damage, it can be a problem retrofitting this design to old mills. Where two irises are needed for coil splitting a coil and the space for the subsequent shear is such that the coil is formed in a structured manner, then there may be insufficient height available in existing mills, or would increase the cost of a new mill installation. For example, the spacing of each component for the desired result may be 0.8 m to 1.0 m in a 2.4 m to 3.0 m assembly. To overcome the problem of lack of space, the present invention provides a combined iris and shear in place of the final shear and iris. This allows for the same two steps to be carried out in a smaller space, or where space and tub length are not an issue, then greater control can be obtained by using a three stage process for controlling the coiling comprising two irises and a third combined iris and shear.

Figure 4A:
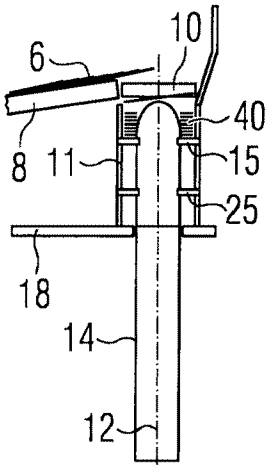
Figure 4B:
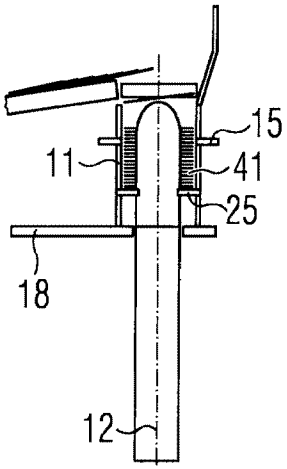

The initial part of the process is very similar. As shown in FIG. 4*a*, loops 6 are brought by the conveyor 8 to the entry to the reform chamber 9. At the entry to the reform chamber 9 is mounted the rotating guide surface, or ring distributor 10, to assist in producing a uniform distribution of coils in a controlled manner. The looped rod drops vertically passing through the ring distributor 10 onto the first iris 15 and the coils are formed inside the reform tub 11. The first iris 15 is set at a position part-way down the reform tub. The plurality of tabs 22 of the iris project through the wall of the reform tub, their tips close to or in contact with the nose cone 13 in the centre of and co-axial with a central axis of the reform tub 11, to support a coil 40 and subsequently retracted through the wall to allow the coil to fall down to the next support level when sensors 21 determine that the coils have reached a predetermined upper height limit and send a signal to a controller 19 to cause the iris tabs 22 to be retracted. In this case, allowing the formed coil 41 drops by a fixed distance to the next support level as shown in FIG. 4*b*.

However, the next support level is a combined iris and shear unit 25. Blades 26 of the combined iris and shear unit extend into the reform tub and provide support for the coil. When a full coil is required and the full coil is formed based on supplying an appropriately sized billet at the input, then this combined iris and shear only performs the support function of the iris and is used to provide the gradual coil build up needed within the reform tub. When the coil is complete, the blades 26 are retracted and the coil drops down to the coil plate 18. The coil plate then moves down taking the wound coil with it and this is then extracted in the usual way.

Figure 4C:
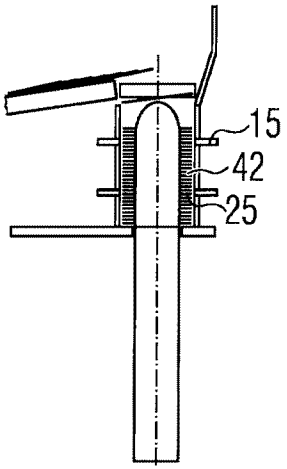
Figure 4D:
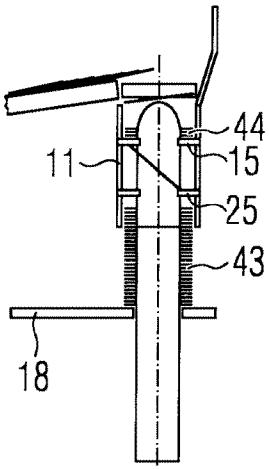

The advantage comes in the ability to use the same arrangement for half or other weights of coil under control of the controller, without changing the structural arrangement. The same double drop operation is used, but when the height limit sensor 21 is triggered for the second time, the combined unit 25 opens as shown in FIG. 4*c* to let the coil 42 drop down to the coil plate 18 and when sensors on the coil plate determine that the required weight has been achieved, the first iris 15 is closed off as shown in FIG. 4*d*, preventing any coils above the first iris from dropping any further and the next coil starts to form. The coil plate 18 descends to open the top of the coil into an open helix, resulting in a section of rod passing at a steep angle through the open combined unit 25 from the top of the wound coil to the bottom of the next coil supported on the first iris 15. With the coil stopped and open, the combined unit is closed and the blades 26 of the combined unit 25 are moved into a cutting position in the reform tub and perform a shearing action to cut the coil.

Figure 4E:
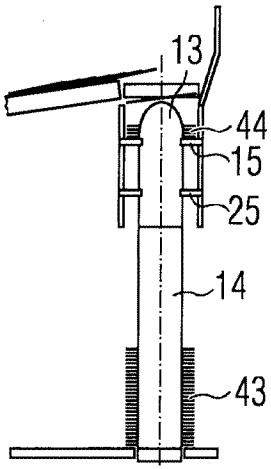

Immediately after cutting, the blades 26 of the combined unit withdraw back to the support position to facilitate the normal two stage coil formation for the second coil (FIG. 4*e*). The stem and formed coil moves for further processing and a second stem is engaged to allow the sequence to begin again. The coil is then moved down again (FIG. 3*e*) on the coil plate 19 and extracted, whilst the formation of the next coil in the reform tub continues. The compactness of the coil formed, the coil height, is governed by the ring distributor 10, how far the coil is allowed to drop between irises 15, 25 and the length of the reform tub 11. Ideally, two irises are used. The combined iris and shear unit 25 allows for more control where a shorter reform tub exists and there is a shear requirement for half coils. The combined unit gives greater precision than if the length of run had to be calculated in advance for each partial coil and the rod cut before winding, but does not take any more space in the reform chamber. By replacing the separate shear and second helix with a combined unit typically 600 mm to 800 mm of vertical distance can be saved, allowing the same functionality in a smaller space. Effectively, one complete set of equipment can be removed, together with its control systems and the overall height of the equipment can be reduced by a third.

Figure 5A:
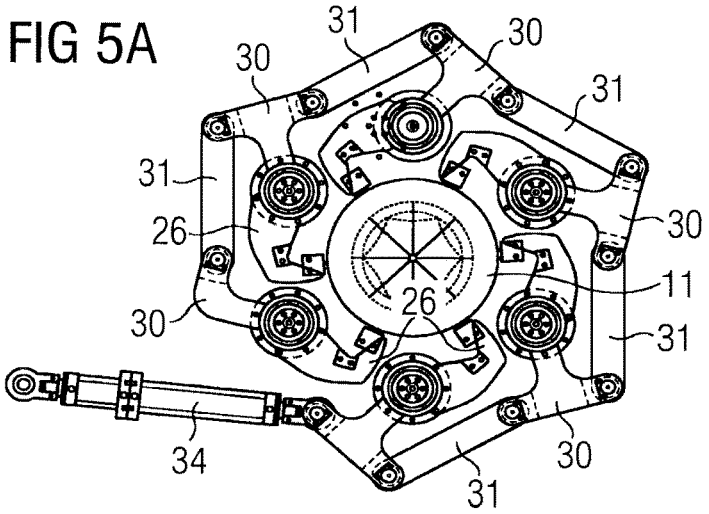
Figure 5B:
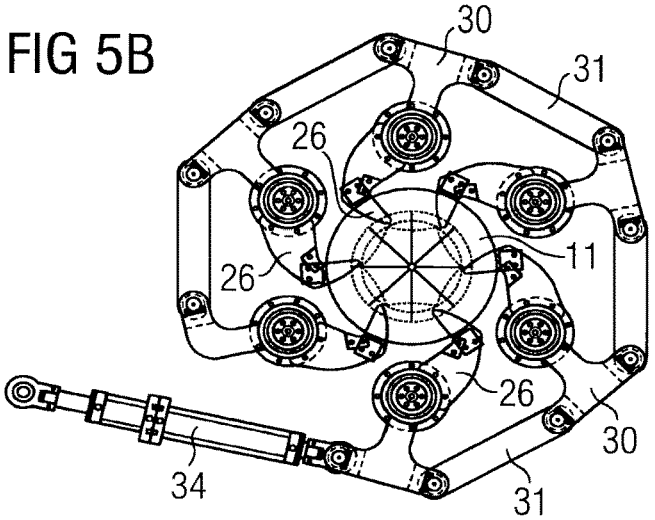
Figure 5C:
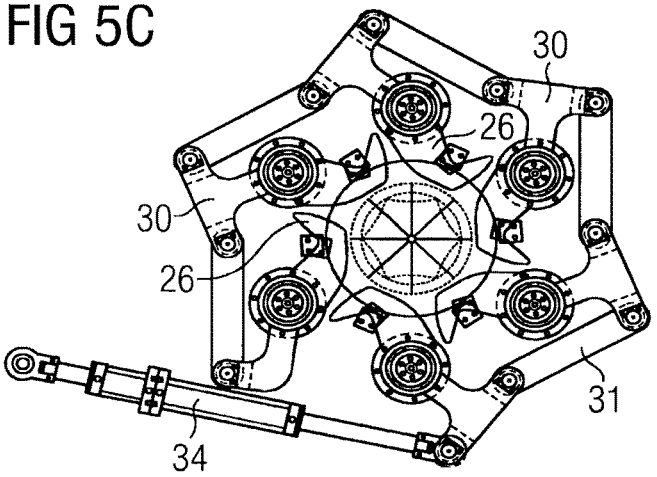

FIG. 5 illustrates the combined iris and shear unit in more detail in its three different stages, open (FIG. 5*a*), support (FIG. 5*b*) and final shearing (FIG. 5*c*). The unit comprises a plurality of articulated mounts 30, coupled together in series by bars 31. On each mount 30 is an iris tab, which can rotate to move towards or away from the reform tub 11. The iris tab comprises a shear blade 26, which is also able to act as a support depending upon the position it is in. FIG. 5*a* shows the unit 25 in its open position with the blades moved away from the reform tub wall, so that coil forming takes place within the reform tub without interference. FIG. 5*b* shows the blades moved into the support position for the coil forming process and FIG. 5*c* illustrates the blades in the shear position for cutting a coil before it is extracted. An actuator 34 receives signals from the controller 19 to cause the blades to move to the required position.

As mentioned before, an alternative is to still use two irises and add a combined unit in the coil forming process if additional control is required, for example where the steel is high carbon steel. In some cases, the vertical distance of the tub is less than the length of the coil to be formed, for example a 3 m coil can be formed in a 1 m reform tub, in which case the partially formed coil on the coil plate is moved down sufficiently to allow the next stage of coil to be formed in the tub, once the first stage has passed through the one or two irises.

I claim:

1. A combined iris and shear unit for a coil forming device, the unit comprising:

an actuator and a plurality of support members coupled together in series to support formation of a coil and connected to the actuator; wherein each support member further comprises a retractable shear blades of a combined iris and shear unit, the actuator adapted to cause movement of the support members between an open position with the retractable blades of the combined iris and shear unit being retracted away from a reform tub wall, so that coil forming takes place within the reform tub without interference;

a support position with the retractable blades extended into the reform tub and providing support for the coil; or a shear position for cutting the coil before it is extracted, wherein the actuator receives signals from a controller to cause the retractable shear blades of the combined iris and shear unit to move to a required position where movement of each of the retractable shear blades occurs in conjunction with movement of one or more supporting member, and a coil height sensor that is positioned at the top of the reform tub and a controller, whereby retraction or extension of the supports is controlled in response to signals from the height sensor received by the controller, wherein when the coil height sensor is triggered a first time the retractable blades of the combined iris and shear unit performs the support function of an iris and is used to provide a gradual coil build up needed within the reform tub, when the coil height sensor is triggered a second time the combined iris and shear unit is opened to let the coil drop to a coil plate, having weight sensors, until a specified coil weight has been achieved and then the combined iris and shear unit is closed, the retractable blades of the combined iris and shear unit are moved into a cutting position.

2. The device according to claim 1, wherein said support members being retractably mounted on the reform tub; and the coil plate at the base of the reform tub; wherein each support member is independently operable.

3. A device according to claim 2, wherein the reform tub is positioned in a housing.

4. A device according to claim 2, wherein one of the supports comprises an iris.

5. A device according to claim 3, wherein one of the supports comprises an iris.

6. A device according to claim 1, wherein one of the supports comprises a combined unit.

7. A device according to claim 3, wherein the reform tub is positioned in a housing.

8. A device according to claim 3, wherein one of the supports comprises an iris.

* * * * *